US010807371B2

(12) United States Patent
Yoda

(10) Patent No.: US 10,807,371 B2
(45) Date of Patent: Oct. 20, 2020

(54) LIQUID DISCHARGE APPARATUS

(71) Applicant: Kazuhisa Yoda, Kanagawa (JP)

(72) Inventor: Kazuhisa Yoda, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 16/391,511

(22) Filed: Apr. 23, 2019

(65) Prior Publication Data

US 2019/0329555 A1 Oct. 31, 2019

(30) Foreign Application Priority Data

Apr. 27, 2018 (JP) ..... 2018-087163
Apr. 15, 2019 (JP) ..... 2019-076946

(51) Int. Cl.
*B41J 2/165* (2006.01)

(52) U.S. Cl.
CPC ..... *B41J 2/16517* (2013.01); *B41J 2/16505* (2013.01)

(58) Field of Classification Search
CPC .... B41J 2/185; B41J 2/16517; B41J 2/16523; B41J 2/16505; B41J 2/1721
See application file for complete search history.

(56) References Cited

U.S. PATENT DOCUMENTS

2009/0218271 A1* 9/2009 Harada ..... B41J 2/17121
2017/0106656 A1* 4/2017 Conzelmann et al. ..... B41J 2/16505

FOREIGN PATENT DOCUMENTS

| | | |
|---|---|---|
| JP | 3-182363 | 8/1991 |
| JP | 4-344256 | 11/1992 |
| JP | 10-058704 | 3/1998 |
| JP | 11-342622 | 12/1999 |
| JP | 2010-253834 | 11/2010 |

* cited by examiner

*Primary Examiner* — Juanita D Jackson
(74) *Attorney, Agent, or Firm* — Harness, Dickey & Pierce, P.L.C.

(57) ABSTRACT

A liquid discharge apparatus includes a liquid discharge head, a liquid receiving portion, an absorbing member, a case, and a shape holder. The liquid discharge head discharges liquid. The liquid receiving portion receives the liquid dummy-discharged from the liquid discharge head. The absorbing member absorbs the liquid. The case is made of a non-liquid permeable material, to house the absorbing member. The shape holder holds a shape of the case.

15 Claims, 12 Drawing Sheets

LIQUID DISCHARGE APPARATUS

CROSS-REFERENCE TO RELATED APPLICATIONS

This patent application is based on and claims priority pursuant to 35 U.S.C. § 119(a) to Japanese Patent Application Nos. 2018-087163, filed on Apr. 27, 2018, and 2019-076946, filed on Apr. 15, 2019, in the Japan Patent Office, the entire disclosure of each of which is incorporated by reference herein.

BACKGROUND

Technical Field

Aspects of the present disclosure relate to a liquid discharge apparatus.

Related Art

A liquid discharge apparatus is known that includes a liquid discharge head to discharge liquid and a liquid receiving portion to receive the liquid which is dummy-discharged from the liquid discharge head for, e.g., maintenance.

SUMMARY

In an aspect of the present disclosure, there is provided a liquid discharge apparatus that includes a liquid discharge head, a liquid receiving portion, an absorbing member, a case, and a shape holder. The liquid discharge head discharges liquid. The liquid receiving portion receives the liquid dummy-discharged from the liquid discharge head. The absorbing member absorbs the liquid. The case is made of a non-liquid permeable material, to house the absorbing member. The shape holder holds a shape of the case.

In an aspect of the present disclosure, there is provided a liquid discharge apparatus that includes a liquid discharge head, a liquid receiving portion, an absorbing member, a case, and a holding case. The liquid discharge head discharges liquid. The liquid receiving portion receives the liquid dummy-discharged from the liquid discharge head. The absorbing member absorbs the liquid. The case is made of resin, to house the absorbing member. The holding case holds the case.

BRIEF DESCRIPTION OF THE DRAWINGS

The aforementioned and other aspects, features, and advantages of the present disclosure would be better understood by reference to the following detailed description when considered in connection with the accompanying drawings, wherein.

Figure 1:
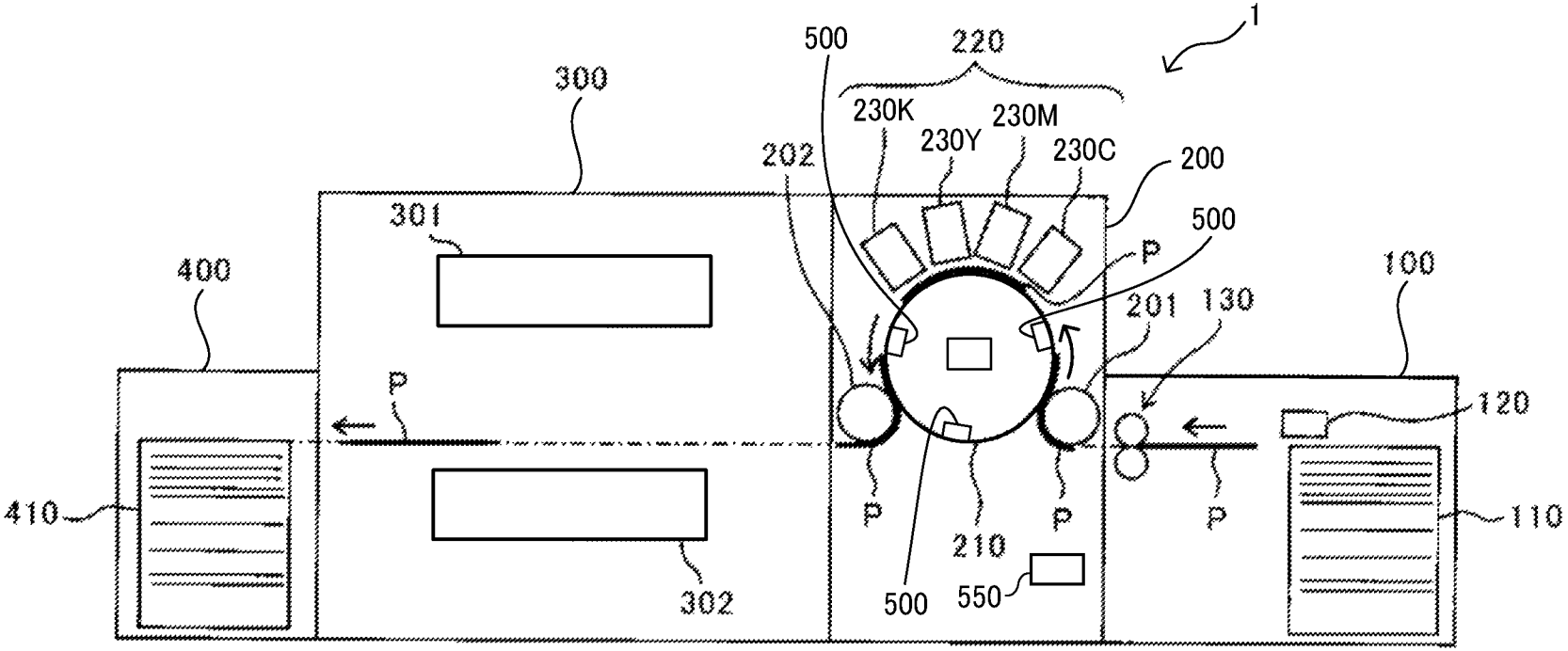
FIG. 1 is a schematic diagram illustrating an outline configuration of a printer that is an inkjet recording apparatus as a "liquid discharge apparatus" according to an embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the embodiments are described with technical limitations with reference to the attached drawings, such description is not intended to limit the scope of the disclosure and all of the components or elements described in the embodiments of this disclosure are not necessarily indispensable.

Referring now to the drawings, embodiments of the present disclosure are described below. In the drawings for explaining the following embodiments, the same reference codes are allocated to elements (members or components) having the same function or shape and redundant descriptions thereof are omitted below.

In the following, an embodiment of the present invention will be described with reference to the drawings.

Hereinafter, embodiments of the present disclosure are described with reference to the drawings.

Overall Description

FIG. 1 is a schematic diagram of an outline configuration of a printer 1 that is an inkjet recording apparatus as a "liquid discharge apparatus" according to an embodiment of the present disclosure. The printer 1 includes a sheet feeding unit 100, an image forming unit 200, a drying unit 300, and a sheet ejection unit 400.

In the printer 1, the image forming unit 200 forms an image with ink, which is liquid for image formation, on a sheet of sheet P (a medium, a sheet material, or a recording material) fed from the sheet feeding unit 100. After the drying unit 300 dries the ink on the sheet P, the sheet P is ejected from the sheet ejection unit 400.

Sheet Feeding Unit

The sheet feeding unit 100 includes a sheet feed tray 110 on which a plurality of sheets of paper P is stacked, a sheet feeding device 120 to separate and feed out the sheets P one by one from the sheet feed tray 110, and a registration roller pair 130 to send the sheet P to the image forming unit 200.

As the sheet feeding device 120, any sheet feeding device, such as a device using a roller or a series of rollers, or a device using air suction can be used. After a leading edge of the sheet P fed from the sheet feed tray 110 by the sheet feeding device 120 reaches the registration roller pair 130, the registration roller pair 130 is driven at a predetermined timing to feed the sheet P to the image forming unit 200.

In the present embodiment, the configuration of the sheet feeding unit 100 is not limited to any particular configuration as long as the sheet feeding unit 100 can feed the sheet P to the image forming unit 200.

Image Forming Unit

Figure 2:
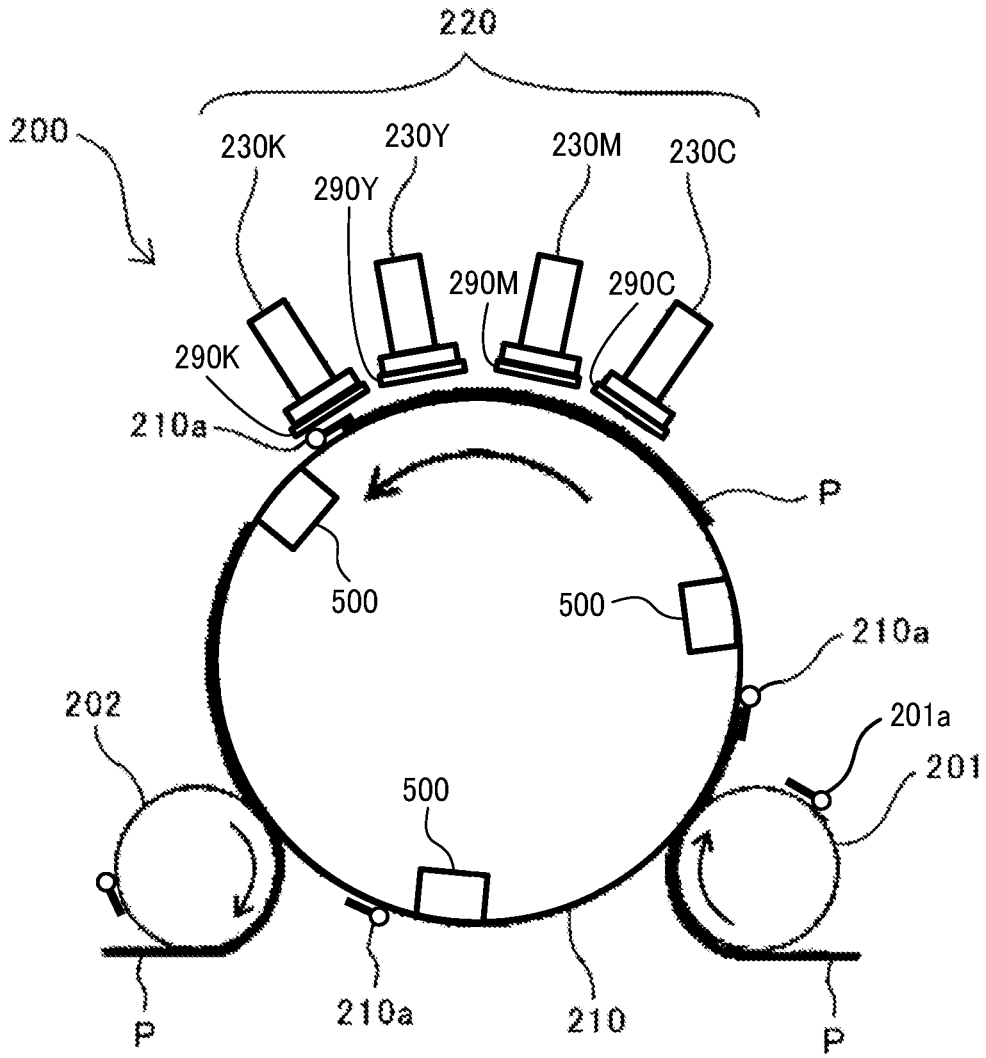
FIG. 2 is a schematic diagram of a configuration of an image forming unit.

The image forming unit 200 includes a receiving cylinder 201, a sheet conveyance drum 210 (a conveyance member), an ink discharger 220, and a delivery cylinder 202. FIG. 2 is a schematic diagram of a configuration of the image forming unit 200. The receiving cylinder 201 receives the fed sheet P (medium) and conveys the sheet P to a downstream side in a direction of conveyance of the sheet P. The sheet conveyance drum 210 is a cylindrical member that bears the sheet P, which is conveyed by the receiving cylinder 201, on the outer peripheral surface and conveys the sheet P. The ink discharger 220 is a mechanism that discharges ink toward the sheet P conveyed by the sheet conveyance drum 210. The delivery cylinder 202 delivers the sheet P conveyed by the sheet conveyance drum 210 to the drying unit 300.

The leading end of the sheet P conveyed from the sheet feeding unit 100 to the image forming unit 200 is held by a sheet receiving gripper 201*a* provided on a surface of the receiving cylinder 201 and is conveyed along with movement of the surface of the receiving cylinder 201. The sheet P conveyed by the receiving cylinder 201 is delivered to the sheet conveyance drum 210 via a position where the receiving cylinder 201 faces the sheet conveyance drum 210.

A sheet conveyance gripper 210*a* is also provided on a surface of the sheet conveyance drum 210, and the leading end of the sheet P delivered to the sheet conveyance drum 210 is held by the sheet conveyance gripper 210*a*. A plurality of suction holes is dispersedly formed on the surface of the sheet conveyance drum 210. In each suction hole, a suction device 211 generates a suction airflow toward an inside of the sheet conveyance drum 210.

The leading end of the sheet P delivered from the receiving cylinder 201 to the sheet conveyance drum 210 is held on the sheet conveyance gripper 210*a* and is attracted to the surface of the sheet conveyance drum 210 by the suction airflow to be conveyed along with the movement of the surface of the sheet conveyance drum 210.

The ink discharger 220 according to the present embodiment discharges four color inks of cyan (C), magenta (M), yellow (Y), and black (K) to form an image and includes separate liquid discharge heads 230 (230C, 230M, 230Y, and 230K) for the respective inks. Since the four liquid discharge heads 230 have similar configurations except for the color of ink to be discharged, the reference signs such as "C", "M", "Y", and "K" indicating the colors of ink to be discharged, may be omitted in the following description according to need.

The configuration of the liquid discharge heads 230 is not limited to any particular configuration and various configurations can be adopted as long as liquid is discharged from discharge orifices. According to need, a liquid discharge head to discharge a special ink such as white, gold, silver, or the like may be provided, or a liquid discharge head to discharge liquid such as surface coating liquid, which does not form an image, may be provided.

The discharging operation of each of the four liquid discharge heads 230 of the ink discharger 220 is controlled by a drive signal according to image information. When the sheet P conveyed by the sheet conveyance drum 210 passes through a region facing the ink discharger 220, the four liquid discharge heads 230 discharge inks of four colors to form an image corresponding to the image information.

In the present embodiment, the configuration of the image forming unit 200 is not limited to any particular configuration as long as an image is formed by attaching liquid onto the sheet P.

Drying Unit

The drying unit 300 includes a drying mechanism 301 to dry ink attached on the sheet P in the image forming unit 200 and a conveyance mechanism 302 to convey the sheet P conveyed from the image forming unit 200.

The sheet P conveyed from the image forming unit 200 is received by the conveyance mechanism 302, conveyed through the drying mechanism 301, and delivered to the sheet ejection unit 400. When the sheet P passes through the drying mechanism 301, drying treatment is performed on the ink on the sheet P so that liquid content such as moisture in the ink evaporates. Thus, the ink is fixed on the sheet P and curling of the sheet P is reduced.

Sheet Ejection Unit

The sheet ejection unit 400 includes a sheet ejection tray 410 on which a plurality of sheet P is stacked. The sheet P conveyed from the drying unit 300 is sequentially stacked and held on the sheet ejection tray 410. In the present embodiment, the configuration of the sheet ejection unit 400 is not limited to any particular configuration as long as the sheet P is ejected.

Other Functional Units

The printer 1 according to the present embodiment includes the sheet feeding unit 100, the image forming unit 200, the drying unit 300, and the sheet ejection unit 400. Other functional units may be added according to need. For example, a preprocessing unit that performs preprocessing of image formation may be added between the sheet feeding unit 100 and the image forming unit 200, and a post-processing unit that performs post-processing of the image formation may be added between the drying unit 300 and the sheet ejection unit 400.

As the preprocessing unit, for example, there may be a method for performing a treatment liquid coating process of applying a treatment liquid on the sheet P to react with the ink and suppress oozing. The content of the pretreatment is not particularly limited.

As the post-processing unit, for example, there may be a sheet inversion conveyance process for reversing the sheet P on which an image is formed by the image forming unit 200 and sending the sheet P again to the image forming unit 200 to form images on both sides of the sheet P, a process of binding a plurality of sheets of sheet P having images formed thereon, and the like. However, the content of the post-processing is not also particularly limited.

The present embodiment describes a liquid discharge apparatus with an example of the printer 1 that is an inkjet recording apparatus. The printer 1 includes the liquid discharge heads 230 that discharge liquid ink toward the surface to be dried of the sheet P, which is a sheet material.

According to the present embodiment, the plurality of liquid discharge heads is arranged in a sheet width direction (a direction orthogonal to the direction of conveyance of the sheet) to form a long-shape liquid discharge head (line head). When it is not particularly mentioned, the "liquid discharge head" represents a "line head".

Each of the liquid discharge heads 230 of the present embodiment is a line type liquid discharge head having a length (length in the main scanning direction) along the width direction of the sheet P, and the individual liquid discharge heads 230 discharge the ink toward the sheet P.

According to the present embodiment, each of the individual liquid discharge heads 230 is separately arranged radially around a rotation axis of the sheet conveyance drum 210.

Depending on the image to be printed and the like, some of the liquid discharge heads 230 may frequently discharge the ink and others may not frequently discharge the ink. In the liquid discharge head 230 which does not frequently discharge the ink, the ink may dry and become thickened, which may hamper a desired amount of ink from being discharged at a desired timing. To prevent such a case, dummy discharge is performed when ink is not discharged for a predetermined period of time.

In the present embodiment, dummy discharge receivers 500 that receive dummy-discharged ink are arranged in the sheet conveyance drum 210 at three positions with equal intervals in the rotation direction of the sheet conveyance drum 210. According to the present embodiment, the dummy discharge receiver 500 is disposed between the sheets of the sheet P held by the sheet conveyance gripper 210*a*.

The sheet conveyance drum 210 and the dummy discharge receivers 500 rotate together. When one of the dummy discharge receivers 500 passes through a position facing the liquid discharge head 230 that has not discharged ink for the predetermined time, the liquid discharge head 230 performs dummy discharge toward the dummy discharge receiver 500.

Figure 3:
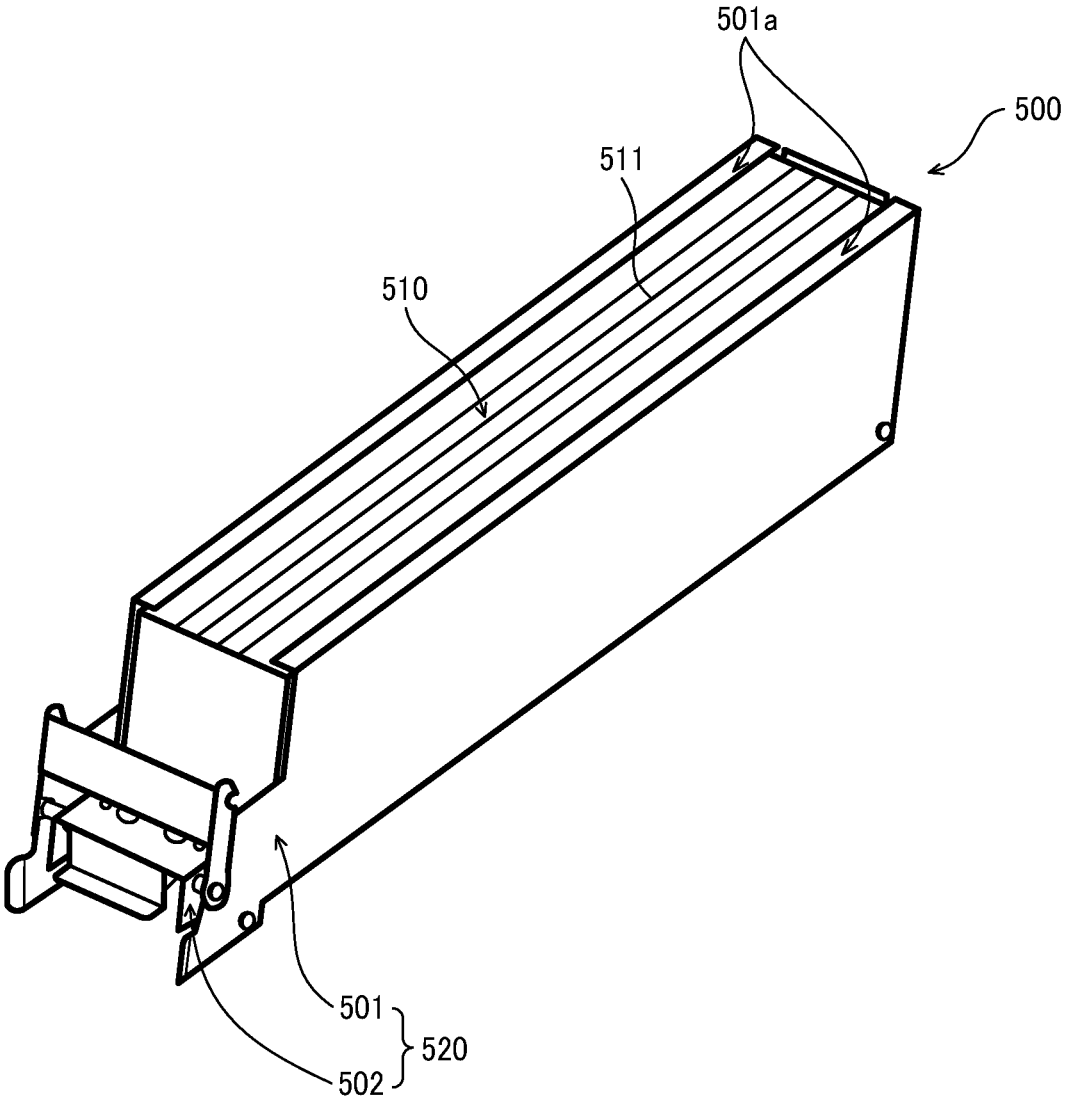
FIG. 3 is a perspective view of a dummy discharge receiver.
Figure 4:
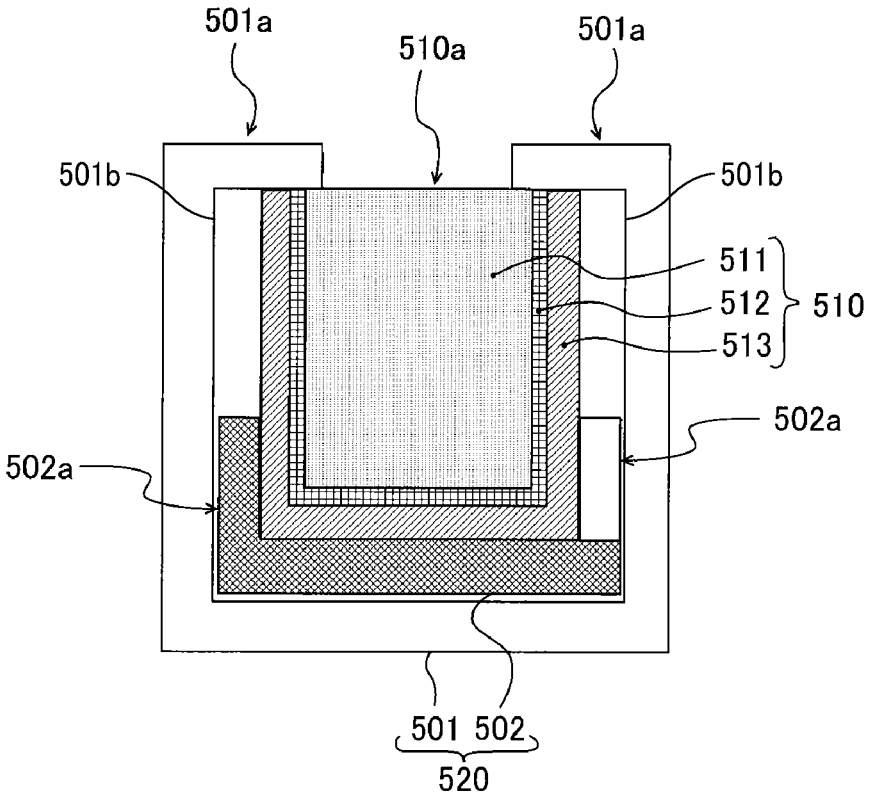
FIG. 4 is a schematic cross-sectional view of the dummy discharge receiver.

FIG. 3 is a perspective view of the dummy discharge receiver 500. FIG. 4 is a schematic cross-sectional view of the dummy discharge receiver 500. The dummy discharge receiver 500 includes a liquid receiving portion 510 to store the ink discharged by the dummy discharging operation and a support 520 to support the liquid receiving portion 510. The support 520 includes a support case 501 and a slide member 502. The support case 501 is attached to the sheet conveyance drum 210 and houses the liquid receiving portion 510. The liquid receiving portion 510 is attached to the slide member 502. The slide member 502 is slidably attached to the support case 501. According to the present embodiment, the liquid receiving portion 510 is detachably attached to the support 520 so that only the liquid receiving portion 510 is replaceable.

The liquid receiving portion 510 includes an absorbing member 511 made of, e.g., sponge to absorb dummy-discharged ink, a film case 512 as a case that houses the absorbing member 511 and is made of a material having no ink permeability, and a holding case 513 as a shape holder that houses the film case 512 and holds the shape of the film case 512.

The support case 501 has a rectangular shape in which one (a front side in FIG. 3) of a pair of surfaces orthogonal to the longitudinal direction (the rotation axis direction of the sheet conveyance drum 210) and a top surface are opened, and houses the slide member 502 and the liquid receiving portion 510 that is attached to the slide member 502. The support case 501 has bent portions 501*a* that are stopper portions bent inward from upper ends of a pair of side surfaces 502*b* as opposed walls parallel to the longitudinal direction. The bent portions 501*a* face an edge of an opening 510*a* of the liquid receiving portion 510.

According to the present embodiment, the dummy discharge receivers 500 are attached to the sheet conveyance drum 210, and the sheet conveyance drum 210 and the dummy discharge receivers 500 rotate together. Accordingly, along with the rotation of the sheet conveyance drum 210, the opening of the support case 501 through which the dummy-discharged ink passes is oriented downward. When the opening faces downward, the bent portions 501*a* of the support case 501 can prevent the liquid receiving portion 510 from dropping off from the opening of the support case 501 due to the weight of the liquid receiving portion 510.

Further, according to the present embodiment, the tip of each bent portion 501*a* is located inside the edge of the opening 510*a* of the liquid receiving portion 510 and the tip portion of each bent portion 501*a* faces the absorbing member 511 of the liquid receiving portion 510. Such a configuration can prevent the absorbing member 511 from dropping off the film case 512 due to its own weight.

As illustrated in FIG. 4, the slide member 502 is provided with a plurality of press-fitting claws 502*a*, and the liquid receiving portion 510 is press-fitted to the press-fitting claws 502*a* and attached to the slide member 502. Press-fitting the liquid receiving portion 510 into the press-fitting claws 502*a* can prevent the liquid receiving portion 510 from dropping from the opening of the support case 501 due to its own weight of the liquid receiving portion 510 when the opening of the support case 501 faces downward.

Figure 5A:
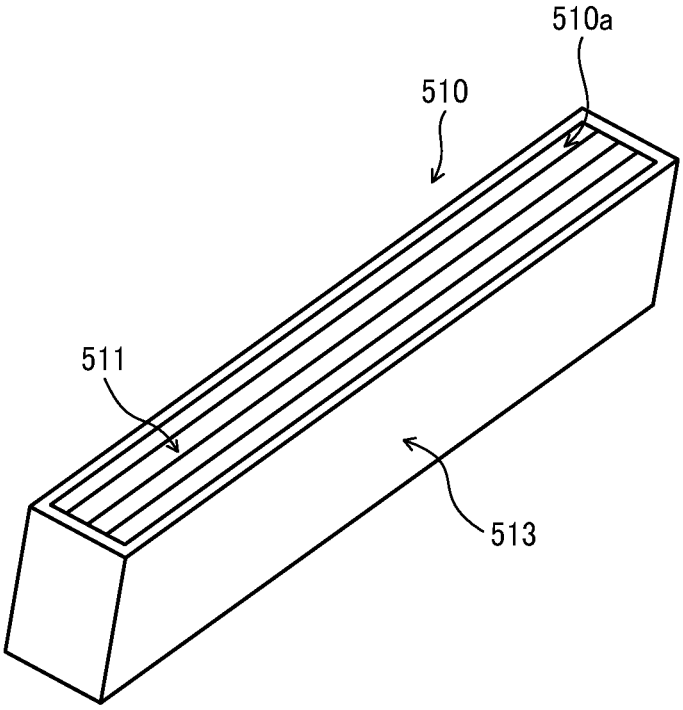
FIGS. 5A and 5B are schematic configuration views of a liquid receiving portion.
Figure 5B:
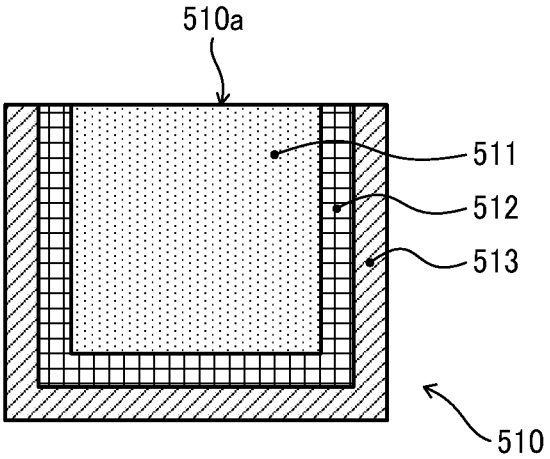
Figure 6A:
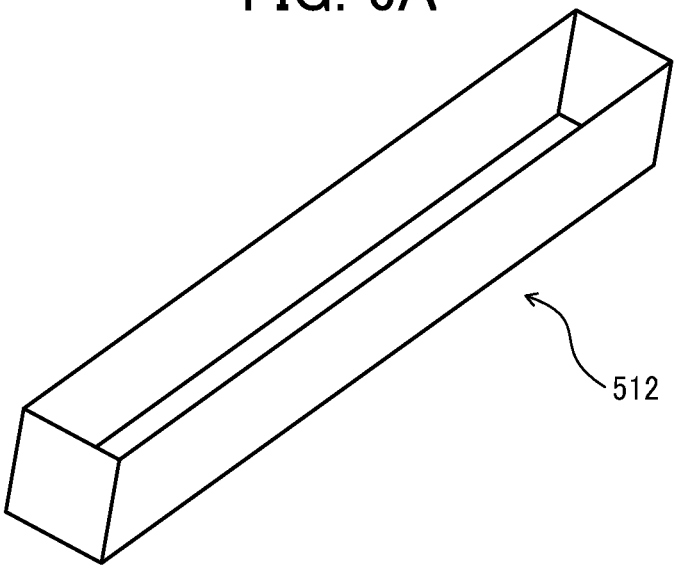
FIG. 6A is a perspective view of a film case.
Figure 6B:
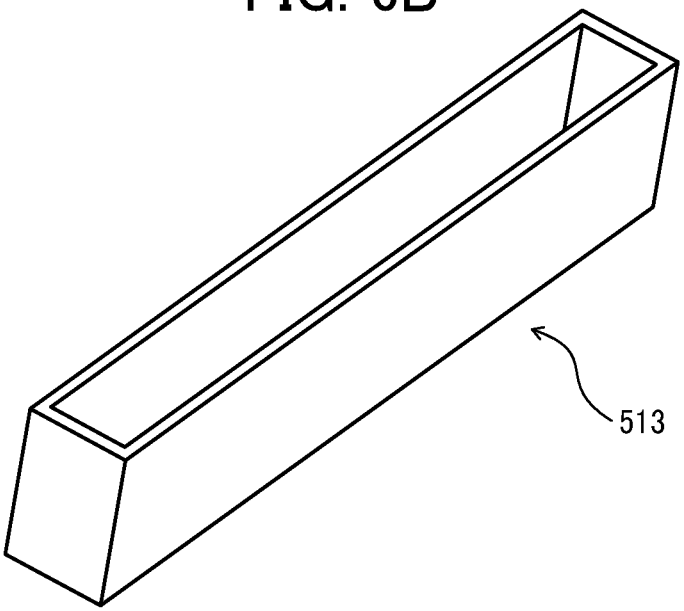
FIG. 6B is a perspective view of a holding case.

FIGS. 5A and 5B are schematic configuration views of the liquid receiving portion 510. FIG. 5A is a perspective view of the liquid receiving portion 510 and FIG. 5B is a cross-sectional view of the liquid receiving portion 510. FIG. 6A is a perspective view of the film case 512, and FIG. 6B is a perspective view of the holding case 513. As described above, the liquid receiving portion 510 includes the absorbing member 511 made of, e.g., sponge, a film case 512 that is a case to house the absorbing member 511 and is made of a material having no ink permeability, a holding case 513 serving as a shape holder to house the film case 512 and hold the shape of the film case 512.

As illustrated in FIG. 5B, the volume of the absorbing member 511 is equal to or larger than the volume of the film case 512 so as to completely fill the interior of the film case 512. With such a configuration, the amount of ink that can be held by the absorbing member 511 can be increased, as compared with a case where the volume of the absorbing member 511 is less than the volume of the film case 512, and, as a result, a replacement cycle of the liquid receiving portion 510 can be lengthened.

As illustrated in FIG. 6A, the film case 512 has a rectangular shape with one surface (upper surface) opened, and the absorbing member 511 is press-fitted into the film case 512. Also, as illustrated in FIG. 6B, the holding case 513 also has a rectangular shape with one side (upper surface) opened as in the film case 512. An outer dimension of the film case 512 is larger than an inner dimension of the holding case 513 and the film case 512 is press-fitted into the holding case 513.

The film case 512 in the present embodiment is a laminate film having a six-layer structure that includes, in turn from the outside, a polyamide (PA) layer (front substrate), a black ink layer (colored layer), an adhesive layer, an aluminum (AL) layer (intermediate substrate), an adhesive layer, and a linear polyethylene layer (made of Linear Low Density Polyethylene: LLDPE) (inner substrate). In addition, the front substrate and the intermediate substrate and the intermediate substrate and the inner substrate are bonded by dry lamination.

The film case 512 formed with a material having no ink permeability can prevent the ink absorbed by the absorbing member 511 from oozing out from the film case 512. As described above, since the ink does not ooze out from the film case 512, the holding case 513 can be made of a material which is less expensive than a material having no ink permeability. According to the present embodiment, the holding case 513 is made of paper so that the holding case 513 can be made inexpensive as compared with the case where the holding case 513 is made of a material such as resin which does not allow ink to pass therethrough.

According to the present embodiment, the dummy discharge receiver 500 is attached to the sheet conveyance drum 210 so that the opening 510*a* (the surface on which the absorbing member 511 is exposed, see FIGS. 5A and 5B), which receives the dummy-discharged ink, of the liquid receiving portion 510 faces outward, and the sheet conveyance drum 210 and the dummy discharge receiver 500 rotate together. Therefore, according to the rotation of the sheet conveyance drum 210, the opening 510*a* of the liquid receiving portion 510 faces downward. However, according to the present embodiment, the absorbing member 511 is provided in the liquid receiving portion 510, and the dummy-discharged ink is absorbed by the absorbing member 511 and held in the absorbing member 511. Such a configuration can prevent ink from dropping out of the opening 510*a* even when the opening 510*a* of the liquid receiving portion 510 faces downward.

In addition, since the absorbing member 511 is press-fitted into the film case 512, the absorbing member 511 does not come off from the film case 512 by its own weight even when the opening 510*a* of the liquid receiving portion 510 faces downward. By press-fitting and attaching the absorbing member 511 to the film case 512, the absorbing member 511 can be easily attached to the film case 512 as compared with the case of using an adhesive or the like to attach the absorbing member 511 to the film case 512.

Further, attaching the film case 512 to the holding case 513 by press fitting can prevent the film case 512 holding the absorbing member 511 from coming off from the holding case 513 by its own weight even when the opening of the liquid receiving portion 510 faces downward. Further, by attaching the film case 512 to the holding case 513 by press-fitting, the film case 512 can be easily attached to the holding case 513, as compared with a case of using an adhesive or the like to attach the film case 512 to the holding case 513.

In addition, conventionally, the liquid receiving portion 510 is composed of the absorbing member 511 and a case that houses the absorbing member 511 therein, the case is made of a material (for example, resin) having no ink permeability so as to have a function of preventing the ink from oozing out and a function of increasing a thickness to hold the shape of the liquid receiving portion. Therefore, the case becomes expensive and this may lead to an increase in cost of the device. On the other hand, according to the present embodiment, a member (film case 512) that fulfills the function of preventing the leakage of ink and a member (holding case 513) that performs the function of maintaining the shape of the liquid receiving portion 510 are each provided, and the function Is separated. As a result, the thickness of the case made of a material having no ink permeability can be reduced as the film case 512. The holding case 513 to hold the shape may be made of paper that is less expensive than a material (for example, resin) having no ink permeability. Accordingly, the liquid receiving portion 510 can be formed at a lower cost than a conventional configuration, and the cost of the device can be reduced. In addition, the cost for replacing the liquid receiving portion 510 can be reduced and the maintenance cost of the device can be lowered. Further, the holding case 513 to hold the shape can be made of a light material such as paper, and the weight of the liquid receiving portion 510 can be reduced.

Further, in a conventional art, when the case is reused, it takes time and labor to remove adhered ink by, for example, cleaning the inside of the case. On the other hand, according to the present embodiment, the holding case 513 can be reused without cleaning or the like, and there is an advantage that the recyclability can be improved as compared with the conventional art.

Figures 7A, 7B, 7C:
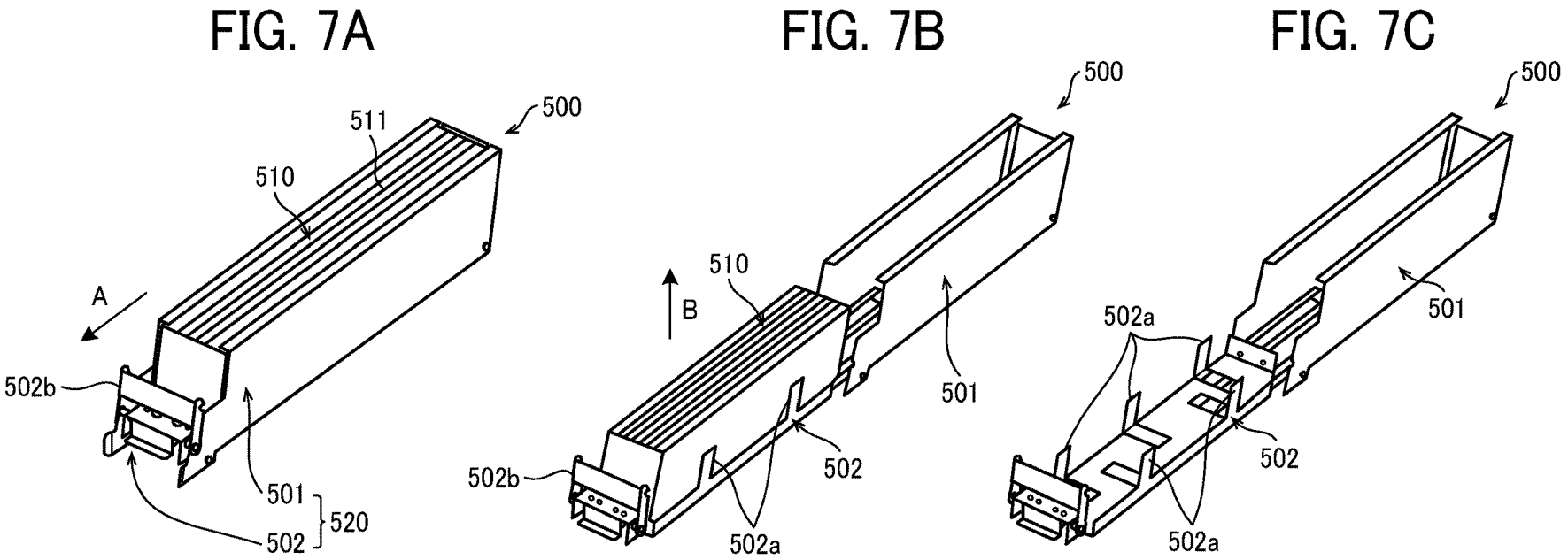
FIGS. 7A to 7C are illustrations of replacement of the liquid receiving portion.

FIGS. 7A to 7C are illustrations of replacement of the liquid receiving portion 510. When a sensor detects that ink in the liquid receiving portion 510 is full, a controller 550 as an example of control circuitry performs replacement control of the liquid receiving portion 510. For example, after the controller 550 controls the rotational driving of the sheet conveyance drum 210 to position the liquid receiving portion 510 at a prescribed position, the controller 550 causes an operation panel of the printer 1 to display that the liquid receiving portion 510 is full of ink. The above prescribed position is a position (for example, a vertex in a vertical direction of the sheet conveyance drum 210) where the opening 510*a* of the liquid receiving portion 510 faces upward. Since the liquid receiving portion 510 is positioned at the position where the opening 510*a* of the liquid receiving portion 510 faces upward in this manner, the ink absorbed by the absorbing member 511 can be prevented from leaking from the opening 510*a* of the liquid receiving portion 510 when the liquid receiving portion 510 is replaced.

Further, since the liquid receiving portion 510, which is to be exchanged, is positioned at the specified position, a space for allowing the slide member 502 to slide is needed only around the prescribed position. Such a configuration can increase the degree of freedom of layout in the device. Further, by positioning the liquid receiving portion 510, which is to be replaced, at the prescribed position, it can be easily recognized which of the plurality of liquid receiving portions 510 is the liquid receiving portion 510 to be replaced. When the operation panel displays an indication that the liquid receiving portion 510 is full of ink, the user performs a replacement operation to replace the liquid receiving portion 510 with a new liquid receiving portion 510 in the following manner. First, the user grips a handle 502*b* of the slide member 502 and slides the slide member 502 in a direction indicated by arrow A in FIG. 7A and, as illustrated in FIG. 7B, the user pulls out the liquid receiving portion 510 from the support case 501. As illustrated in FIGS. 7B and 7C, the plurality of press-fitting claws 502*a* is provided on the slide member 502, and the liquid receiving portion 510 has been press-fitted into the press-fitting claws 502*a* to be attached to the slide member 502. Accordingly, the user can remove the liquid receiving portion 510 from the slide member 502 only by pulling out the liquid receiving portion 510 with respect to the slide member 502 in a direction indicated by arrow B in FIG. 7B. With such a configuration, the liquid receiving portion 510 can be easily removed from the device body, compared to a case where a screw or the like is used to attach the liquid receiving portion 510 to the slide member 502.

Then, after the new liquid receiving portion 510 is press-fitted and attached to the slide member 502, the slide member 502 is pushed into the support case 501. In this manner, according to the present embodiment, since only the liquid receiving portion 510 is replaced and the support case 501 and the slide member 502 are reused, a number of parts to be replaced can be reduced and the maintenance cost can be reduced, compared to a case where the entire dummy discharge receiver 500 is replaced with a new dummy discharge receiver 500.

Further, according to the present embodiment, since the liquid receiving portion 510 is attached and the slide member 502 slidable with respect to the support case 501 is provided, the liquid receiving portion 510 can be pulled out from the support case 501 and the liquid receiving portion 510 can be replaced. With such a configuration, the liquid receiving portion 510 can be easily replaced, compared to a case where the liquid receiving portion 510 stored in the support case 501 is directly extracted from the support case 501.

Next, a variation of the liquid receiving portion 510 is described.

First Variation

Figure 8A:
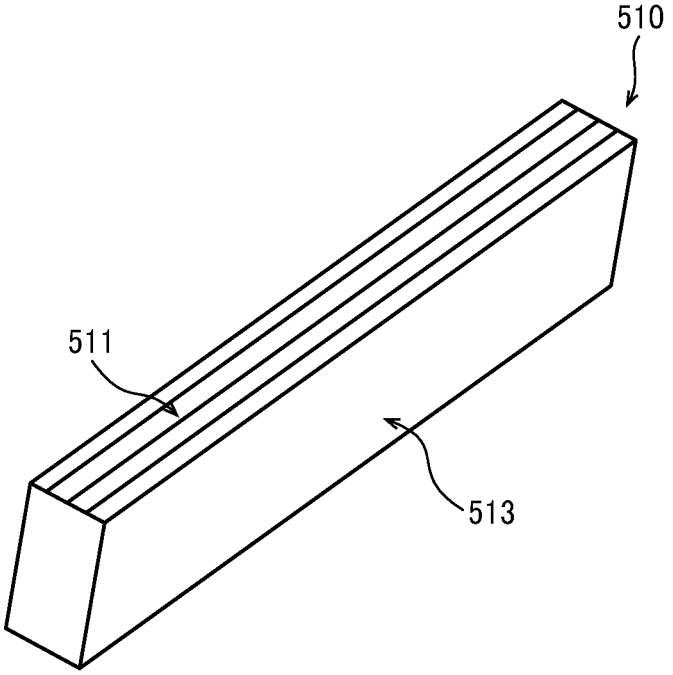
FIGS. 8A and 8B are schematic configuration views of the liquid receiving portion according to a first variation.
Figure 8B:
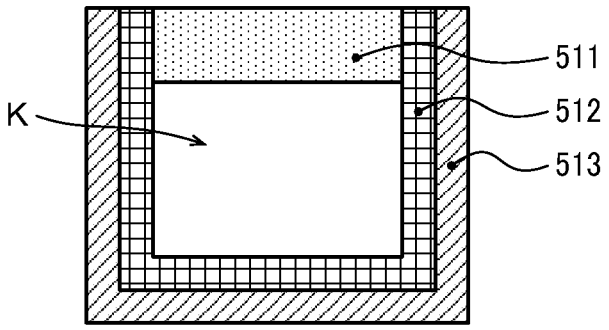
Figure 9C:
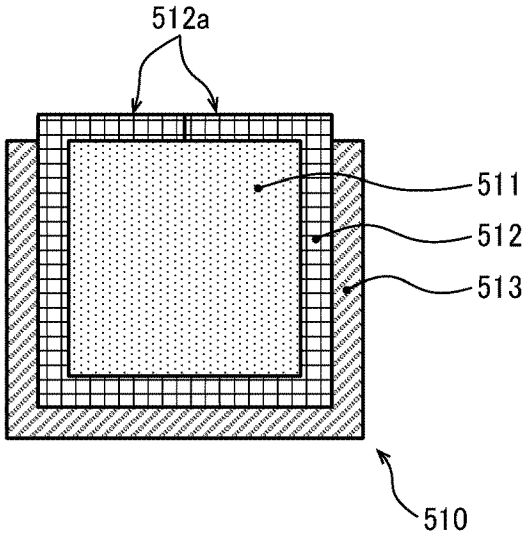
FIGS. 9A to 9C are schematic configuration views of the liquid receiving portion according to a second variation.
Figure 9B:
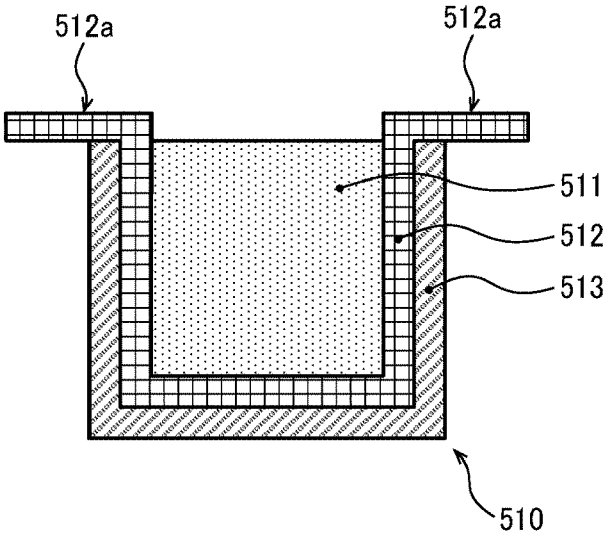
Figure 9A:
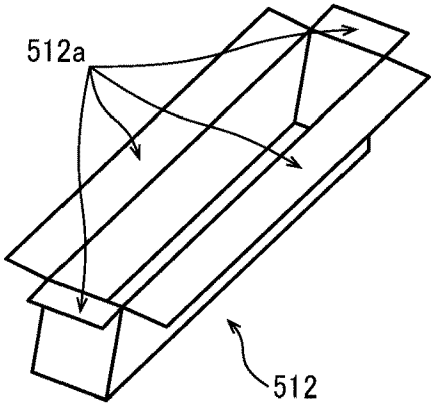

FIGS. 8A and 8B are schematic configuration views of the liquid receiving portion 510 according to a first variation. In the liquid receiving portion 510 according to the first variation, the volume of the absorbing member 511 is smaller than the volume of the film case 512. As illustrated in FIG. 8B, the absorbing member 511 is provided so as to close the opening of the film case 512, and forms a cavity K in the film case. The first variation achieves an advantage that the cost of the absorbing member 511 and the device can be lowered, compared to a case where the volume of the absorbing member 511 is made equal to the volume of the film case 512, Second Variation FIGS. 9A to 9C are schematic configuration views of the liquid receiving portion 510 according to a second variation. In the liquid receiving portion 510 according to the second variation, opening-and-closing portions 512*a* to open and close the opening 510*a* of the liquid receiving portion 510 are provided in the film case 512. As illustrated in FIGS. 9A and 9B, the opening-and-closing portions 512*a* are provided on a pair of side surfaces parallel to the longitudinal direction of the film case 512 and a pair of side surfaces parallel to the short direction, respectively. When the liquid receiving portion 510 is in use, the opening-and-closing portions 512*a* are bent outward as illustrated in FIGS. 9A and 9B, and open the opening 510*a* of the liquid receiving portion 510. When the liquid receiving portion 510 is replaced, the opening-and-closing portions 512*a* are bent inward so as to close the opening 510*a* of the liquid receiving portion 510 and the liquid receiving portion 510 is taken out from the device body. When the opening 510*a* is closed with the opening-and-closing portions 512*a*, it is preferable to secure the opening-and-closing portions 512*a* at the closed position with an adhesive, an adhesive tape, or the like. When the opening 510*a* is closed with the opening-and-closing portions 512*a* at the time of replacement in such a manner, the ink can be prevented from leaking or dropping from the opening 510*a* of the liquid receiving portion 510 during replacement.

Third Variation

Figure 10A:
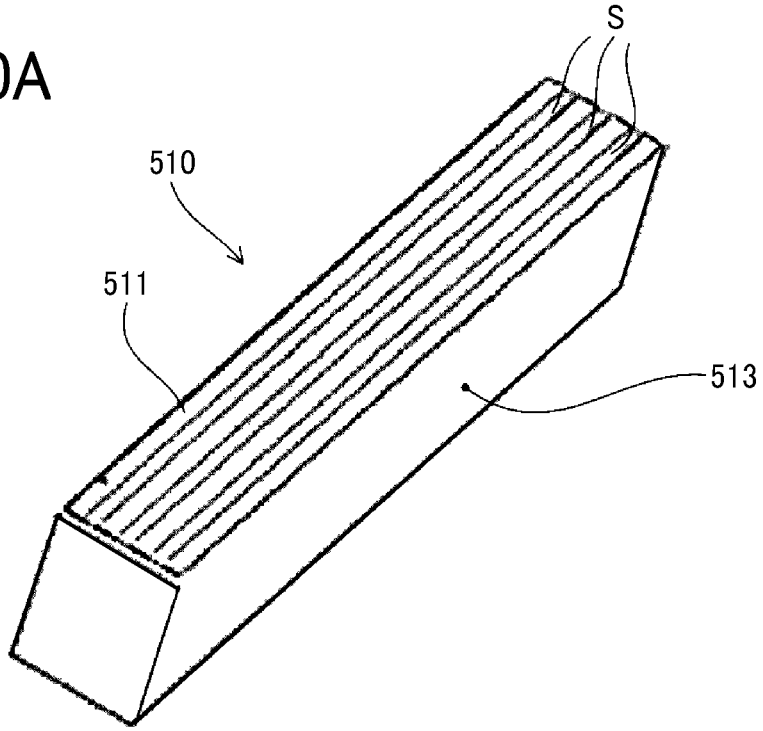
FIGS. 10A and 10B are schematic configuration views of the liquid receiving portion according to a third variation.
Figure 10B:
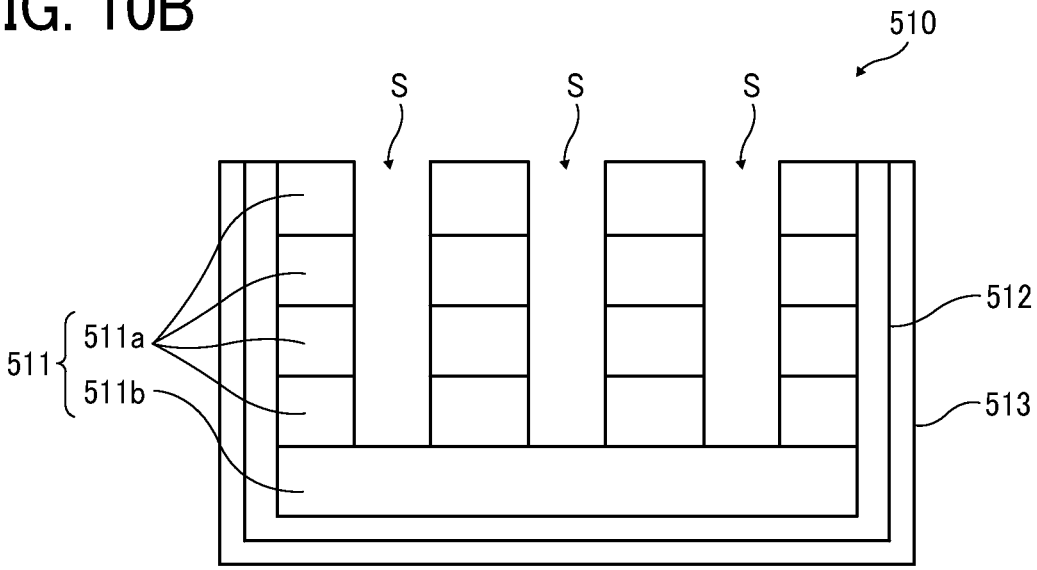

FIGS. 10A and 10B are schematic configuration views of the liquid receiving portion 510 according to a third variation. As illustrated in FIGS. 10A and 10B, in the third variation, the absorbing member 511 is provided with slits S. The slit S has a shape of a narrow, thin groove extending in the longitudinal direction of the liquid receiving portion 510 and opens at a side at which the opening 510*a* of the liquid receiving portion 510 is disposed.

Figure 11:
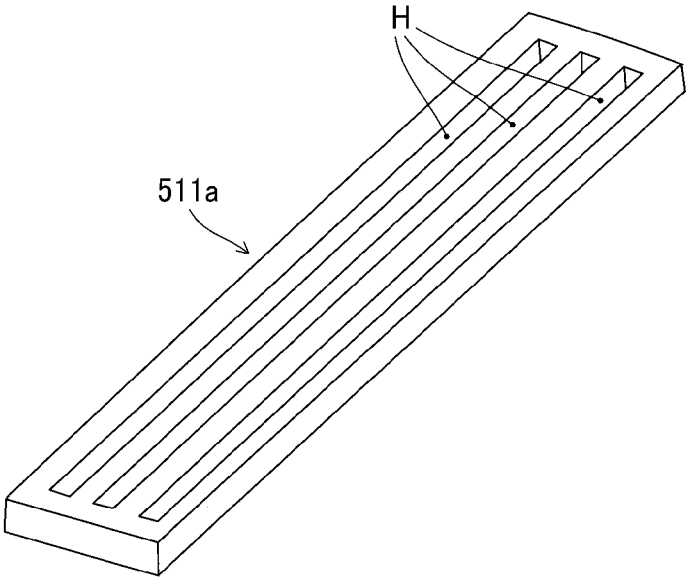
FIG. 11 is a perspective view of an absorber having a through hole.

As illustrated in FIG. 10B, a plurality of absorbers 511*a* having rectangular through holes H extending in the longitudinal direction illustrated in FIG. 11 is stacked on an absorber 511*b* not having the through holes H, to form the absorbing member 511 having the slits S.

Dried ink or thickened ink may be discharged to the absorbing member 511. For the configuration in which the absorbing member 511 is accommodated in the film case 512 without a gap as in the present embodiment or the configuration in which the absorbing member 511 is disposed to close the opening of the film case 512 as in the first variation (see FIG. 8B), dried ink or thickened ink discharged toward the absorbing member 511 might be deposited on the upper surface (the surface on the opening side of the film case 512) of the absorbing member 511 without being absorbed by the absorbing member 511. As a result, in use over time, the ink deposited on the upper surface of the absorbing member 511 may grow and eventually contact the ink ejection surface of the liquid discharge head 230. Therefore, the liquid receiving portion 510 is replaced before the ink deposited on the upper surface of the absorbing member 511 comes into contact with the ink discharge surface, and the replacement cycle of the liquid receiving portion 510 might be shortened.

Hence, in the third variation, the absorbing member 511 is provided with the slits S (gaps (thin grooves) that extend in the longitudinal direction and are open at the opening side of the film case 512). In the liquid discharge head 230, dummy discharge is performed at the timing when the slits S of the absorbing member 511 face nozzle rows, and the ink is dummy-discharged toward the slits S. Thus, dried ink or thickened ink can be deposited on the slits S of the absorbing member 511. Accordingly, compared with the case where the ink is deposited on the upper surface of the absorbing member 511, the position at which the ink is deposited can be kept away from the liquid discharge head 230. As a result, compared to the case where the ink is deposited on the upper surface of the absorbing member 511, the time until the ink deposited on the absorbing member 511 grows to a height at which the ink contacts the ink discharge surface of the liquid discharge head 230 can be extended. The replacement cycle of the liquid receiving portion 510 can be lengthened.

Further, as in the third variation, by forming the slits S as the narrow grooves in the absorbing member 511, ink dummy-discharged on dried ink deposited in the slits S can reliably flow down to the side surfaces of the slits S (the side surfaces on the downstream side in the sheet conveyance direction) by the time when the opening of the liquid receiving portion 510 is directed downward, and the ink dummy-discharged from the side surfaces of the slits S can be absorbed by the absorbing member 511. Thus, when the opening of the liquid receiving portion 510 is directed downward, the ink can be prevented from dropping from the opening of the liquid receiving portion 510, thus preventing the apparatus from being soiled.

Further, formation of the slits S can suppress the decrease in the volume of the absorbing member 511 and the decrease in the amount of ink that can be held by the absorbing member 511, as compared to the case where the absorbing member 511 has a wide recess. Such a configuration can suppress the shortening of the replacement cycle of the liquid receiving portion 510 due to the decrease in the amount of ink which can be held by the absorbing member 511.

Alternatively, the absorbing member may have a recessed portion with a certain width, and the ink may be dummy-discharged to the recessed portion. Such a configuration can also extend the time until the ink deposited on the absorbing member 511 comes into contact with the ink discharge surface.

In the third variation, the number of the slits S is three. For example, one of the three slits S is subjected to dummy discharge and changed to another of the slits S at timing when the ink deposited on the slit S becomes full. The liquid discharge head or the dummy discharge receiver 500 may be provided with, for example, a sensor to detect the height of ink deposited in the slit S. When the sensor detects that the top of the ink deposited in the slit S has reached the opening of the slit S, the slit S subjected to dummy discharge may be changed.

Alternatively, the slit S subjected to dummy discharge may be changed for each dummy discharge in such a manner that, for example, the first dummy discharge is performed on the most upstream slit S in the sheet conveyance direction, the second dummy discharge is performed on the middle slit S in the sheet conveyance direction, and the third dummy discharge is perform on the most downstream slit S in the sheet conveyance direction.

In the present embodiment, the number of the slits S is three. However, the number of slits may be appropriately determined depending on the ease with which ink is dried. For example, when using an ink that is difficult to dry, an apparatus may use ink that is unlikely to be so thickened when dummy-discharged and is more likely to be absorbed by the absorbing member 511 than deposited in the slit S. In such a case, it is preferable to reduce the number of slits S and increase the volume of the absorbing member 511 so that a large amount of ink can be absorbed, thus allowing extension of the replacement cycle of the liquid receiving portion 510.

On the other hand, when using an ink that is easy to dry, the apparatus may use ink that is likely to be dummy-discharged in a thickened or dried state and is more likely to be deposited in the slit S than absorbed by the absorbing member 511. In such a case, it is preferable to increase the number of slits S and to allow more ink to be deposited, thus allowing extension of the replacement cycle of the liquid receiving portion 510.

The width of the slit S is set in accordance with the nozzle rows of the liquid discharge head 230, the rotational speed of the sheet conveyance drum 210, and the like so that dummy-discharged ink reliably enters the slit S.

Figure 12:
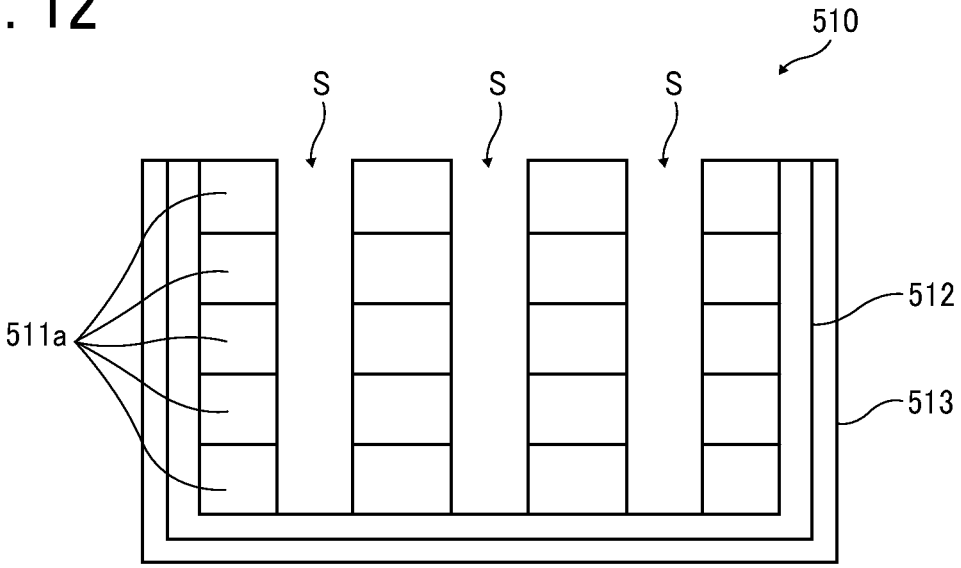
FIG. 12 is a cross-sectional view the liquid receiving portion according to the third variation in which an absorbing member includes only absorbers having through holes.

Further, as illustrated in FIG. 12, the absorbing member 511 having the slits S may be formed of only the plurality of absorbers 511*a* that have the through holes H and are stacked. With such a configuration, the components forming the absorbing member 511 can be reduced to one type. As compared with the case in which the absorbing member is configured by combining the absorbers 511*a* having the through holes H and the absorber 511*b* not having the through hole H, the number of components can be reduced, thus allowing cost reduction of the liquid receiving portion 510. Accordingly, the running cost of the apparatus can be reduced. Note that, as illustrated in FIG. 10B, the absorbing member 511 may be configured by combining the absorbers 511*a* having the through-holes H and the absorber 511*b* not having the through-hole H. In such a case, as compared with the case in which the absorbing member 511 is formed only with the absorbing members 511*a* having the through-holes H, the volume of the absorbing member 511 can be increased, thus achieving an advantage that more ink can be absorbed. Therefore, in the case of an apparatus that uses an ink which is more likely to be absorbed by the absorbing member than deposited in the slit S, for example, the apparatus that uses an ink which is difficult to dry, the absorbing member 511 preferably has the configuration illustrated in FIG. 10B. On the other hand, in the case of an apparatus that uses an ink that is more likely to be deposited in the slit S than absorbed by the absorbing member, for example, the apparatus that uses an ink that is easy to dry, the absorbing member 511 preferably has the configuration illustrated in FIG. 12.

Figure 13:
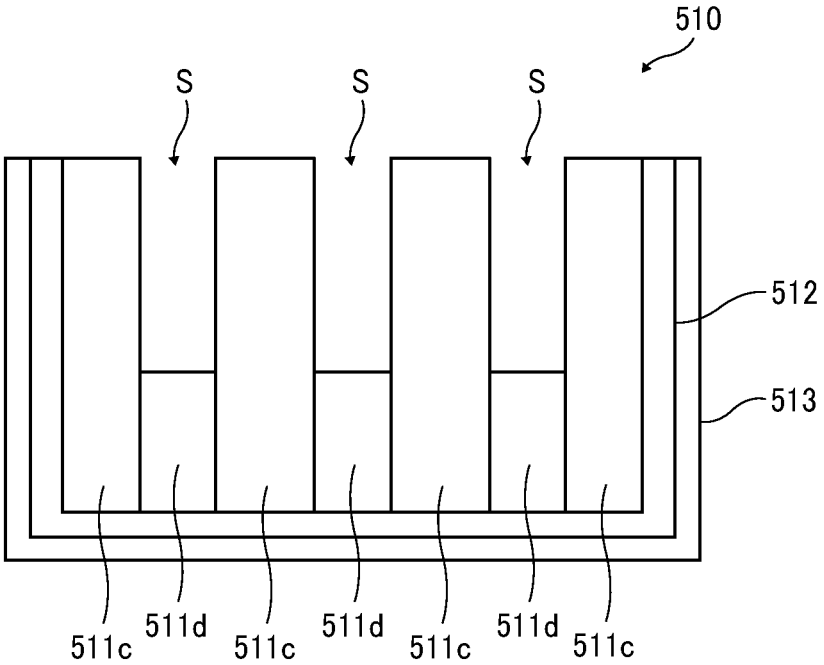
FIG. 13 is a cross-sectional view of the liquid receiving portion according to the third variation in which the absorbing member includes two absorbers that have different heights from each other and are alternately arranging.

Further, as illustrated in FIG. 13, absorbers 511*c* and 511*d* having different heights may be alternately arranged in the short direction of the film case 512 to constitute the absorbing member 511 having the slits S. In the configuration illustrated in FIG. 13, there is an advantage that the processing of the absorber is easier than the configuration illustrated in FIG. 11 in which the plurality of absorbers 511*a* in which the through holes H are formed is stacked.

Figure 14:
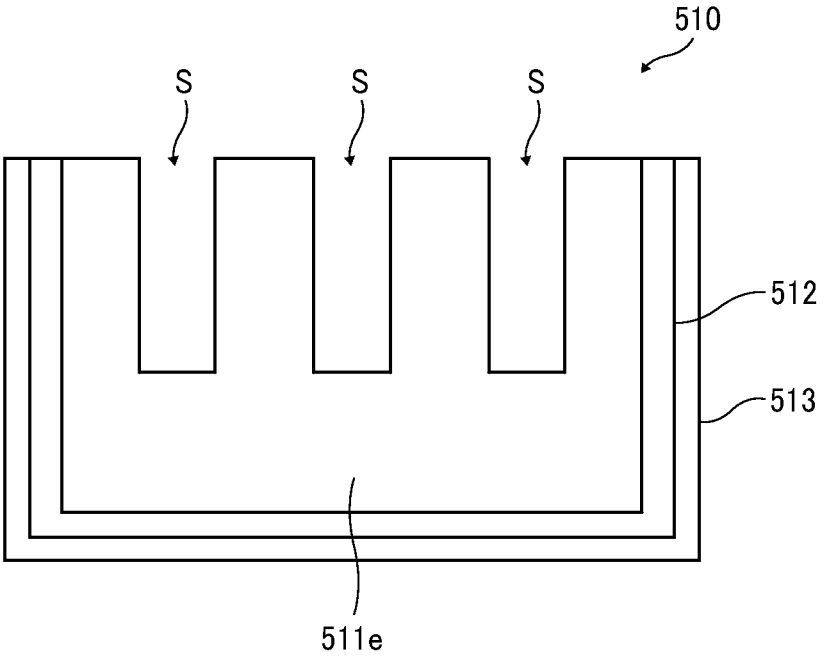
FIG. 14 is a cross-sectional view of the liquid receiving portion according to the third variation in which the absorbing member includes one absorber in which a plurality of slits is formed.

Further, as illustrated in FIG. 14, the absorbing member 511 may be configured of one absorber 511*e* in which a plurality of slits S (thin grooves that extend in the longitudinal direction and are open at the opening side of the film case 512) is formed. With such a configuration, there is an advantage that the number of assembling steps can be reduced as compared to the case where the absorbing member is configured of a plurality of absorbers.

The slit S preferably has a configuration in which ink discharged from the liquid discharge head 230 can be introduced and at least a part of the ink can adhere to the side surface of the slit S. The width and length of the slit S are not particularly limited. Both ends of the slit S in the extending direction of the slit S may be closed or open. The width of the slits may be uniform or nonuniform.

For example, the side surface of the slit S may be inclined so that the width of the slit S increases toward the opening of the film case 512 or the width of the slit S narrows toward the opening of the film case 512. By forming the slit S so that the width of the slit S increases toward the opening of the film case 512, ink can be reliably discharged into the slit. On the other hand, for the configuration in which the width of the slit S narrows toward the opening of the film case 512, even when the ink in the slit drops in the form of droplets when the opening of the liquid receiving portion 510 faces downward, ink can be received by the side surface of the slit S, thus preventing the apparatus from being soiled.

Further, in the third variation, ink is dummy-discharged into the slit S. Therefore, for example, the liquid receiving portion 510 may have a configuration in which the upper surface of the film case is closed and slits corresponding to the slits S of the absorbing member 511 are formed on the upper surface of the film case. Alternatively, the upper surface of the holding case 513 may be closed, and slits corresponding to the slits S of the absorbing member 511 may be formed on the upper surface of the holding case 513.

In the present embodiment, the "liquid discharge head" represents a functional component that discharges and ejects a liquid from discharge holes (nozzles). The discharged liquid is not particularly limited as long as it has a viscosity and a surface tension with which the liquid can be discharged from the head, but it is preferable that the viscosity is 30 [mPa·s] or less at ordinary temperature and ordinary pressure or by heating or cooling. More specifically, there are a solution, a suspension, an emulsion, and the like including a solvent such as water or an organic solvent, a colorant such as a dye or a pigment, a functionalizing material such as a polymerizable compound, a resin, or a surfactant, a biocompatible material such as deoxyribonucleic acid (DNA), amino acid, protein, calcium, or the like, edible materials such as natural pigments, and the like. These can be used, for example, as an inkjet ink, a surface treatment liquid, a liquid for forming a constituent element of an electronic element and a light emitting element or an electronic circuit resist pattern, a material liquid for three-dimensional shaping, and the like. As an energy generating source to discharge a liquid, there are a piezoelectric actuator (laminated type piezoelectric element or thin film type piezoelectric element), a thermal actuator using an electrothermal transducer such as a heating resistor, an electrostatic actuator including a diaphragm and a counter electrode, and the like.

According to the present embodiment, since the plurality of liquid discharge heads is arranged in the sheet width direction (direction orthogonal to the conveying direction), a long liquid discharge head (line head) is formed and the liquid discharge head does not move with respect to the device body. As the liquid discharge head, a "liquid discharge unit" may be formed together with other parts to perform printing as moving with respect to the device body.

The "liquid discharge unit" is composed of the liquid discharge head integrated with a functional part and a mechanism, and is an assembly of parts related to the liquid discharging. For example, the "liquid discharge unit" includes at least one of configurations of a supply circulation mechanism, a carriage, a maintenance and recovery mechanism, and a main scanning movement mechanism, combined with the liquid discharge head. Here, the integration includes, for example, a unit in which the liquid discharge head is secured to the functional part and the mechanism each other by fastening, adhesion, engagement, or the like or a unit in which the one of the liquid discharge head and the functional part or the mechanism is held movably with respect to the other. Further, the liquid discharge head, the functional parts, and the mechanism may be configured to be detachable from each other.

For example, there is a liquid discharge unit in which a liquid discharge head and a supply circulation mechanism are integrally provided. In addition, there is a liquid discharge head and a supply circulation mechanism are connected to each other with a tube or the like and integrated with each other. Here, it is also possible to add a unit including a filter between the supply circulation mechanism of these liquid discharge units and the liquid discharge head. Further, there is a liquid discharge unit in which a liquid discharge head and a carriage are integrated. In addition, there is a liquid discharge unit in which a liquid discharge head and a scanning movement mechanism are integrated by movably holding a liquid discharge head on a guide member constituting a part of the scanning movement mechanism. In addition, there is a liquid discharge unit in which a cap member, which is a part of a maintenance and recovery mechanism, is secured to a carriage to which a liquid discharge head is attached so that the liquid discharge head, the carriage, and the maintenance and recovery mechanism are integrated. In addition, there is a liquid discharge unit in which a tube is connected to a liquid discharge head to which a supply circulation mechanism or a flow path component is attached, and the liquid discharge head and the supply mechanism are integrated. Through this tube, the liquid of the liquid storage source is supplied to the liquid discharge head. The main scanning movement mechanism also includes a single guide member. Further, the supply mechanism includes a single tube and a single loading unit.

The "liquid discharge apparatus" is an apparatus that includes a liquid discharge head or a liquid discharge unit and drives the liquid discharge head to discharge a liquid. The liquid discharge apparatus may be an apparatus which discharges a liquid towards air or liquid, in addition to an apparatus capable of discharging a liquid to a liquid adherable material. The "liquid discharge apparatus" may include devices to feed, convey, and eject the material on which liquid can adhere. The liquid discharge apparatus may further include a pretreatment apparatus to coat a treatment liquid onto the material, and a post-treatment apparatus to coat a treatment liquid onto the material, onto which the liquid has been discharged.

As the "liquid discharge apparatus", there are an image forming apparatus for forming an image on a sheet of paper by discharging an ink, a solid modeling apparatus (three-dimensional modeling apparatus) for discharging a modeling liquid to a powder layer formed with a powder material to form a solid modeled object (three-dimensional modeled object), and the like. Further, the "liquid discharge apparatus" is not limited to an apparatus that visualizes a significant image such as a letter, a figure, or the like with a discharged liquid. For example, the liquid discharge apparatus includes an apparatus to form meaningless images, such as meaningless patterns, or fabricate three-dimensional images.

The "liquid adherable material" is a material on which a liquid can be attached at least temporarily, and indicates a material on which a liquid is adhered and fixed, adhered and permeated, and the like. As detailed examples, the material may be a medium including a recording medium such as a sheet of paper, a recording sheet, recording paper, a film, cloth, and the like, an electronic part such as an electronic substrate, a piezoelectric element, and the like, a powder material layer (powder layer), an organ model, an inspection cell, and the like, and any liquid adherable material can be included unless a specific limitation is applied. The material of the "liquid adherable material" may be paper, thread, fiber, cloth, leather, metal, plastic, glass, wood, ceramics, or the like as long as a liquid can be adhered at least for a short time. The shape of the "liquid adherable material" is not limited to a sheet like the sheet P, and any shape may be used as long as a liquid adheres thereto. The "liquid adherable material", for example, may be a material used for film products, cloth products such as clothing, building materials such as wallpaper and a flooring material, leather products, and the like.

The "liquid" is not particularly limited as long as it has a viscosity and a surface tension with which the liquid can be discharged from the head, but it is preferable that the viscosity is 30 [mPa·s] or less at normal temperature and normal pressure, or by heating and cooling. More specifically, there are a solution, a suspension, an emulsion, and the like including a solvent such as water or an organic solvent, a colorant such as a dye or a pigment, a functionalizing material such as a polymerizable compound, a resin, or a surfactant, a biocompatible material such as deoxyribonucleic acid (DNA), amino acid, protein, calcium, or the like, edible materials such as natural pigments, and the like. These can be used, for example, as an inkjet ink, a surface treatment liquid, a liquid for forming a constituent element of an electronic element and a light emitting element or an electronic circuit resist pattern, a material liquid for three-dimensional shaping, and the like.

Further, the printer 1 according to the present embodiment is a "liquid discharge apparatus" in which a liquid discharge head and a liquid adherable material relatively move. As specific examples of the apparatus which relatively moves its internal unit, there are a line type apparatus which does not move the liquid discharge head as described in the present embodiment, a serial type apparatus which moves the liquid discharge head, and the like. The "liquid discharge apparatus" is not limited to an apparatus in which a liquid discharge head and a liquid adherable material relatively move.

As the "liquid discharge apparatus", there is a treatment liquid application apparatus for discharging treatment liquid onto a sheet to apply the treatment liquid to a surface of the sheet for the purpose of adjusting the surface of the sheet of paper. In addition, there is an injection granulation apparatus which injects a composition liquid including a raw material dispersed in a solution through a nozzle and granules fine particles of the raw material. Further, in the terms of the present application, image formation, recording, typing, copying, printing, shaping, and the like are assumed to be all synonymous.

The above-described embodiments are limited examples and, for example, the following aspects of the present disclosure may have advantageous effects described below.

First Aspect

A liquid discharge apparatus includes a liquid discharge head such as the liquid discharge head 230 to discharge liquid such as ink and a liquid receiving portion such as the liquid receiving portion 510 to receive the liquid dummy-discharged from the liquid discharge head, an absorbing member such as the absorbing member 511 to absorb the liquid, a case such as the film case 512 to house the absorbing member and being made of a non-liquid permeable material, and a shape holder such as the holding case 513 to hold a shape of the case. For example, in a case where a liquid receiving portion is formed with an absorbing member and a waste liquid case that houses the absorbing member, the cost of an apparatus may increase since a waste liquid case is made with a non-liquid permeable material so that the liquid absorbed by the absorbing member does not ooze out and the thickness of the waste liquid case is increased to some extent in order to maintain the shape. On the other hand, the liquid receiving portion according to the first aspect includes the case that houses the absorbing member to absorb the liquid and is made of the non-liquid permeable material and the shape holder to hold the shape of the case. As described above, according to the first aspect, the case has only the function of preventing the liquid from oozing, and the function of maintaining the shape is provided to the shape holder so that the function is divided. Therefore, the thickness of the case made of the non-liquid permeable material can be reduced, and the shape holder can be made of a material such as paper, which is less expensive than the non-liquid permeable material. Such a configuration can produce the liquid receiving portion at low cost and reduce the cost of the apparatus, compared to the case where the thickness of the case made of a non-liquid permeable material is made larger to provide a single case with both of the function of preventing liquid from oozing and the function of maintaining the shape.

Second Aspect

In the liquid discharge apparatus according to the first aspect, a material of the shape holder such as the holding case 513 includes paper. With such a configuration, as described in the above-described embodiment, the shape holder such as the holding case 513 can be made inexpensive, and the weight of the holding case 513 can be reduced. Accordingly, the cost and weight of the liquid receiving portion 510 can be reduced.

Third Aspect

The liquid discharge apparatus according to the first or second aspect further includes a support such as the support 520 that supports the liquid receiving portion such as the liquid receiving portion 510. The liquid receiving portion is detachably attached to the support. With such a configuration, when the liquid receiving portion 510 is full of the liquid, only the liquid receiving portion 510 can be replaced and the maintenance cost can be reduced, compared with the case of replacing the dummy discharge receiver 500 including the support 520 and the liquid receiving portion 510.

Fourth Aspect

The liquid discharge apparatus according to the third aspect further includes a conveyance drum such as the cylindrical sheet conveyance drum 210 that rotates to convey a medium such as the sheet P to which the liquid discharge head such as the liquid discharge head 230 discharges the liquid. The support such as the support 520 is disposed on the conveyance drum. The liquid discharge apparatus further includes control circuitry such as the controller 550 to cause the conveyance drum to rotate so that the support 520 is positioned at a prescribed rotational position in response to attachment and detachment of the liquid receiving portion with respect to the support. With such a configuration, as described in the above-described embodiment, it is sufficient to design the vicinity of the prescribed rotational position so that the liquid receiving portion such as the liquid receiving portion 510 can be attached and detached, thus increasing the degree of freedom of the layout in the apparatus. Further, the prescribed rotational position may be the position at which the opening 510*a* of the liquid receiving portion 510 for receiving the liquid such as a dummy-discharged ink faces upward. With such a configuration, when replacing the liquid receiving portion such as the liquid receiving portion 510, the liquid such as the ink can be prevented from dropping from an opening of the liquid receiving portion such as the opening 510*a* of the liquid receiving portion 510.

Fifth Aspect

In the liquid discharge apparatus according to the third or fourth aspect, the support such as the support 520 includes a support case such as the support case 501 to house the liquid receiving portion such as the liquid receiving portion 510, and a slide member such as the slide member 502 to hold the liquid receiving portion and being slidable with respect to the support case. With such a configuration, as described in the above-described embodiment, the slide member such as the slide member 502 is slid and the liquid receiving portion can be pulled out from the support case such as the support case 501 and replaced, thus facilitating the replacement of the liquid receiving portion 510.

Sixth Aspect

The liquid discharge apparatus according to any one of the first to fifth aspects further includes a support such as the support 520 to support the liquid receiving portion. The liquid receiving portion is press-fitted into the support (the liquid receiving portion 510 is press-fitted into the slide member 502 of the support 520 in the above-described embodiment). With such a configuration, as described in the above-described embodiment, the liquid receiving portion such as the liquid receiving portion 510 can be prevented from falling off from the support such as the support 520. In addition, the liquid receiving portion such as the liquid receiving portion 510 can be easily attached to the support such as the support 520, compared with the case where the liquid receiving portion is attached to the support using a screw or the like.

Seventh Aspect

The liquid discharge apparatus according to any one of the first to sixth aspects includes a support such as the support 520 to support the liquid receiving portion such as the liquid receiving portion 510. The support includes a support case such as the support case 501 to house the liquid receiving portion. The support case has an opposing wall such as the side face 501*b* and a stopper portion such as the bent portion 501*a*. The opposing wall is opposed to a side surface of the case such as the film case 512 extending in a longitudinal direction of the case. The stopper portion such as the bent portion 501*a* is bent from the opposing wall and is opposed to an edge of an opening of the case such as the film case 512. Such a configuration can prevent the liquid receiving portion such as the liquid receiving portion 510 placed in the support case such as the support case 501 from coming off from the support case.

Eighth Aspect

In the liquid discharge apparatus according to any one of the first to seventh aspects, the volume of the absorbing member such as the absorbing member 511 is less than the volume of the case such as the film case 512. With such a configuration, the cost of the absorbing member such as the absorbing member 511 can be reduced and the cost of the apparatus can be lowered, as compared with the case where the volume of the absorbing member is equal to the volume of the case such as the film case 512 as described in the first variation.

Ninth Aspect

In the liquid discharge apparatus according to any one of the first to eighth aspects, the case such as the film case 512 has an opening-and-closing portion such as the opening-and-closing portion 512*a* to open and close an opening 510*a* of the liquid receiving portion 510 such as the opening 510*a* of the liquid receiving portion 510. With such a configuration, as described in the second variation, the opening of the liquid receiving portion can be closed by the opening-and-closing portion and the liquid receiving portion can be replaced. Such a configuration can prevent the liquid such as ink from leaking out or falling from the opening of the liquid receiving portion when the liquid receiving portion is replaced.

Tenth Aspect

In the liquid discharge apparatus according to the first to ninth aspects, the absorbing member such as the absorbing member 511 is press-fitted into the case such as the film case 512, and an outer dimension of the case is larger than an inner dimension of the shape holder such as the holding case 513. As described in the above-described embodiment, such a configuration can prevent the absorbing member such as the absorbing member 511 from coming off from the case such as the film case 512. Further, since the outer dimension of the case is larger than the inner dimension of the shape holder such as the holding case 513, the case is press-fitted into the shape holder, thus preventing the case from coming off from the shape holder.

Eleventh Aspect

A liquid discharge apparatus includes a liquid discharge head such as the liquid discharge head 230 to discharge liquid such as ink and a liquid receiving portion such as the liquid receiving portion 510 to receive the liquid dummy-discharged from the liquid discharge head, an absorbing member such as the absorbing member 511 to absorb the liquid, a case such as the film case 512 made of resin to house the absorbing member, and a holding case such as the holding case 513 to hold the case such as the film case 512. Such a configuration can form the liquid receiving portion inexpensively and reduce the cost of the apparatus.

Twelfth Aspect

In the liquid discharge apparatus according to any one of the first to eleventh aspects, the absorbing member such as the absorbing member 511 has a slit such as the slit S. As described in the embodiment, such a configuration can dummy-discharge liquid such as ink to the slit of the absorbing member and deposing the liquid in the slit of the absorbing member. Accordingly, the period of time until the ink deposited on the absorbing member reaches the position of a discharge surface of the liquid discharge head such as the liquid discharge head 230 can be extended, thus allowing extension of the replacement cycle of the liquid receiving portion.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

The invention claimed is:

1. A liquid discharge apparatus comprising:

a liquid discharge head to discharge liquid;

a dummy discharge receiver, the dummy discharge receiver including an absorbing member to absorb the liquid dummy-discharged from the liquid discharge head;

a case made of a non-liquid permeable material, to house the absorbing member; and a shape holder, surrounding the case, to hold a shape of the case.

2. The liquid discharge apparatus according to claim 1, wherein a material of the shape holder includes paper.

3. The liquid discharge apparatus according to claim 1, further comprising a support to support the dummy discharge receiver, wherein the liquid receiving portion is detachably attached to the support.

4. The liquid discharge apparatus according to claim 3, further comprising a cylindrical conveyance drum to rotate to convey a medium to which the liquid discharge head discharges the liquid, the support being disposed on the conveyance drum; and control circuitry to cause the conveyance drum to rotate so that the support is positioned at a prescribed rotational position in response to attachment and detachment of the dummy discharge receiver with respect to the support.

5. The liquid discharge apparatus according to claim 3, wherein the support includes a support case to house the dummy discharge receiver and a slide member to hold the dummy discharge receiver, wherein the slide member is slidable with respect to the support case.

6. The liquid discharge apparatus according to claim 1, further comprising a support to support the dummy discharge receiver, wherein the dummy discharge receiver is press-fitted into the support.

7. The liquid discharge apparatus according to claim 1, further comprising a support to support the dummy discharge receiver, wherein the support includes a support case to house the dummy discharge receiver, wherein the support case includes an opposing wall opposed to a side surface of the case extending in a longitudinal direction of the case and a stopper portion bent from the opposing wall and opposed to an edge of an opening of the case.

8. The liquid discharge apparatus according to claim 1, wherein a volume of the absorber is less than a volume of the case.

9. The liquid discharge apparatus according to claim 1, wherein the case includes an opening-and-closing portion to open and close an opening of the dummy discharge receiver.

10. The liquid discharge apparatus according to claim 1, wherein the absorbing member is press-fitted to the case, and wherein an outer dimension of the case is greater than an inner dimension of the shape holder.

11. A liquid discharge apparatus comprising:

a liquid discharge head to discharge liquid;

a dummy discharge receiver, the dummy discharge receiver including an absorbing member to absorb the liquid dummy discharge from the liquid discharge head;

a case made of resin, to house the absorbing member; and a holding case, surrounding the case, to hold the case.

12. The liquid discharge apparatus according to claim 1, wherein the absorbing member has slits.

13. A liquid discharge apparatus comprising:

a liquid discharge head to discharge liquid;

a dummy discharge receiver to absorb the liquid dummy-discharged from the liquid discharge head; and a support to support the dummy discharge receiver, the support includes a support case to house the dummy discharge receiver and a slide member to hold the dummy discharge receiver, wherein the slide member is slidable with respect to the support case.

14. The liquid discharge apparatus according to claim 13, wherein the liquid receiving portion is detachably attached to the support.

15. The liquid discharge apparatus according to claim 13, wherein the dummy discharging receiver including an absorbing member to absorb the liquid dummy-discharged from the liquid discharge head;

a case made of a non-liquid permeable material, to house the absorbing member; and a shape holder, surrounding the case, to hold a shape of the case.

* * * * *